United States Patent [19]

Forbes

[11] Patent Number: 4,925,192

[45] Date of Patent: May 15, 1990

[54] GOLF TRAINING APPARATUS

[76] Inventor: Vaughn T. Forbes, 905 W. Helena Dr., Phoenix, Ariz. 85023

[21] Appl. No.: 325,396

[22] Filed: Mar. 20, 1989

[51] Int. Cl.[5] ..... A63B 69/36

[52] U.S. Cl. ..... 273/187 R; 273/188 A

[58] Field of Search ..... 273/187 R, 187 A, 187 B, 273/188 R, 188 A, 183 A

[56] References Cited

U.S. PATENT DOCUMENTS

| | | | |
|---|---|---|---|
| 3,041,075 | 6/1962 | Taylor | 273/187 R |
| 3,229,981 | 1/1966 | Taber | 273/187 R |
| 3,610,632 | 10/1971 | Caldwell | 273/187 R |
| 4,718,674 | 1/1988 | Henry | 273/187 R |

FOREIGN PATENT DOCUMENTS

| | | | |
|---|---|---|---|
| 16930 | of 1911 | United Kingdom | 273/187 R |
| 591840 | 8/1947 | United Kingdom | 273/187 R |
| 2149310 | 6/1985 | United Kingdom | 273/187 R |

*Primary Examiner*—George J. Marlo

*Attorney, Agent, or Firm*—H. Gordon Shields

[57] ABSTRACT

Golf training apparatus includes four elements, including a primary element and three elements that are secured to the primary element for locating the feet of a user for training a golfer for a correct stance for different kinds of swings. The elements are secured together at any of a plurality of locations by pins and apertures. The primary or base element includes a plurality of apertures, and the other three elements include pins which may extend into any desired aperture. The elements are appropriately secured to the ground, as by anchor pins. The apparatus may also be used in a different configuration for putting and chipping training purposes. The apparatus is also compact and nestable for storage and for transport purposes.

19 Claims, 2 Drawing Sheets

FIG. 1
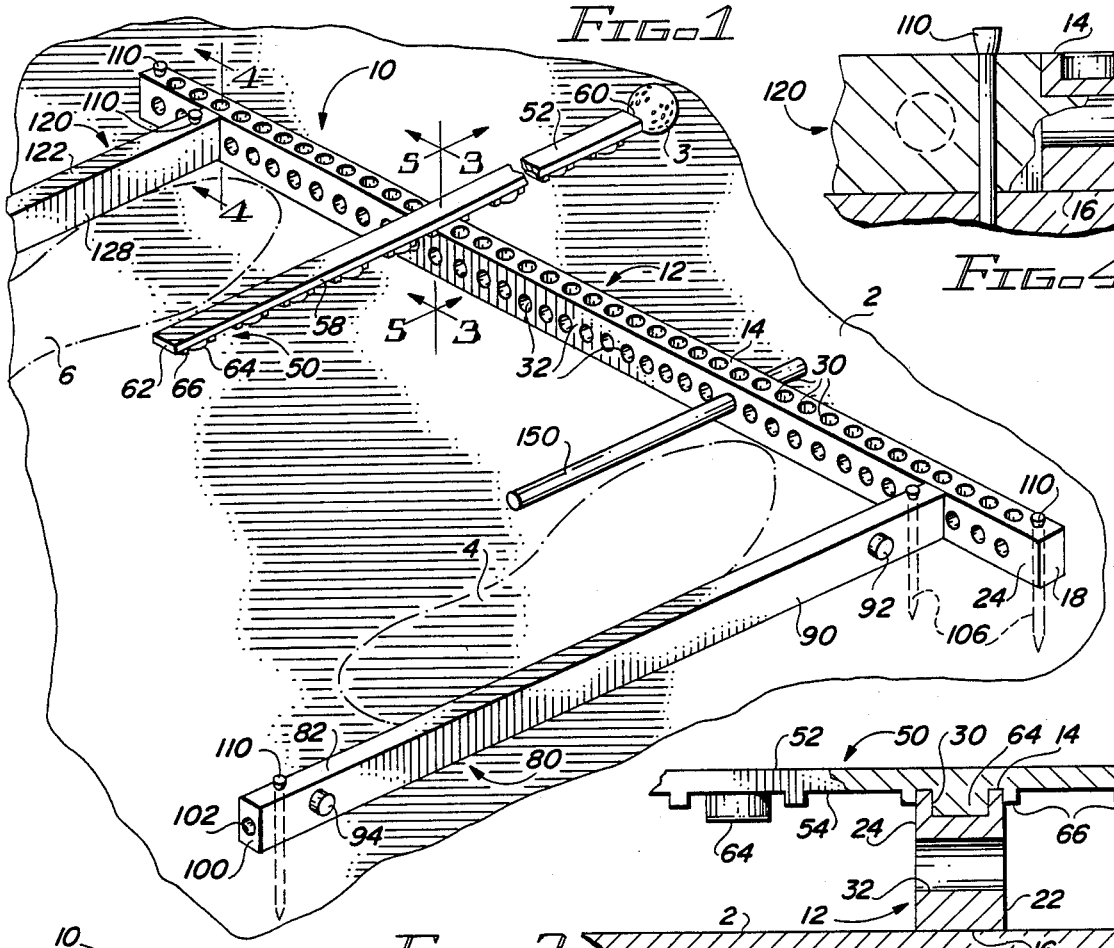
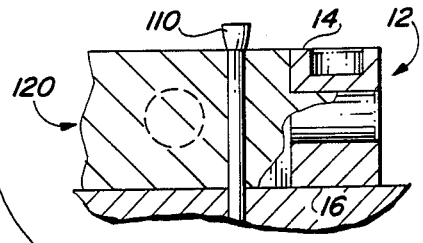
FIG. 4
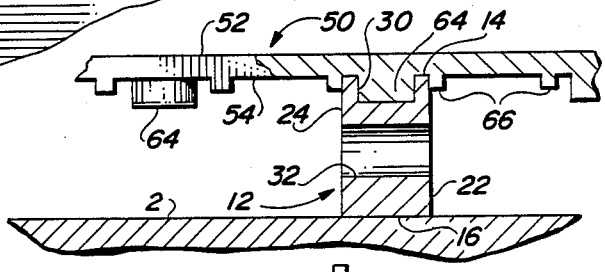
FIG. 3
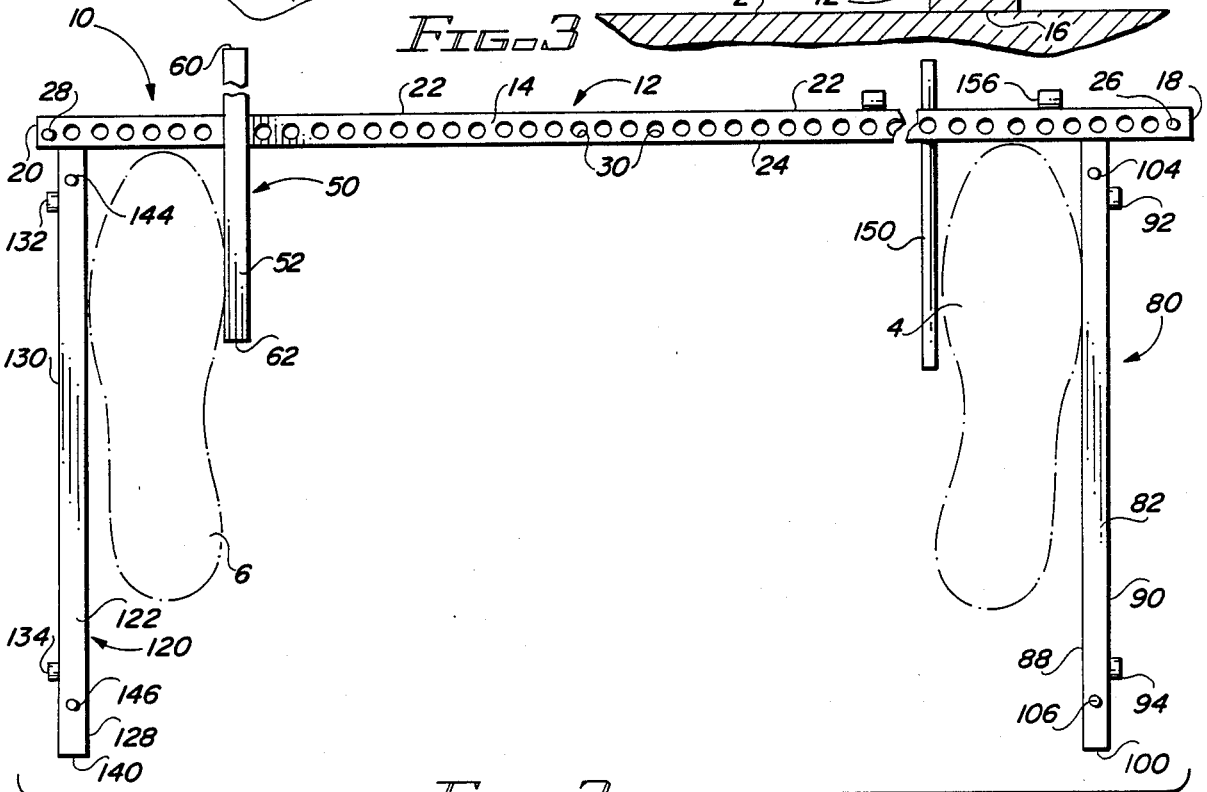
FIG. 2

GOLF TRAINING APPARATUS

BACKGROUND OF THE INVENTION

1. Field Of The Invention

The invention relates to golf training apparatus, and, more particularly, to training apparatus for the placement of a golfer's feet for the proper stance for driving, pitching, and putting.

2. Background Of The Invention

U.S. Pat. No. 2,786,683 (Shapiro) discloses a golf practice mat for practicing indoors or outdoors. Guide lines on the mat may be used for alignment purposes.

U.S. Pat. No. 3,332,688 (Gevertz) discloses a golf putting aid in the form of sheet member with parallel lines on it and with markings on it for aiding the user for ball and blade location. Distance indicia are also marked on the sheet member.

U.S. Pat. No. 3,415,523 (Boldt) discloses golf training apparatus for aiding a golfer to develop a proper swing. The apparatus includes mechanical elements secured to the user and to the user's golf club for training purposes.

U.S. Pat. No. 3,473,811 (Lees) discloses a golf training device which includes a frame with locating elements for locating the ball. The apparatus includes a framework having a particular surface and locating elements on the framework.

U.S. Pat. No. 3,638,950 (Hyotlaine) discloses a golfer's stance gauge for training a golfer to have a proper stance for addressing a ball. Mechanical elements which are adjustable relative to each other are included.

U.S. Pat. No. 3,870,315 (Lawlor) discloses a golf swing training apparatus including a pair of guide rails mounted on a base. The guide rails are adjustable for the individual user. Indicia are also located on the base for the user's reference purposes.

U.S. Pat. No. 3,994,501 (O'Donnell) discloses another type of golf swing practice apparatus. The apparatus includes two plates or pads adjustably spaced apart and with adjustable elements on the pads for training the golfer. The apparatus also includes electronic elements for providing information to the user.

U.S. Pat. No. 4,023,810 (Lorang) discloses golf training apparatus including a board with positions noted for a user's feet and with positions noted for ball placement for different types of swings or shots.

U.S. Pat. No. 4,146,231 (Merkle et al) discloses golf swing training apparatus including a frame with movable elements on the frame for the user's feet and for ball placement for different kinds of swings or shots.

U.S. Pat. No. 4,423,875 (Miller) discloses a golf training aid including a frame having telescoping rails and adjustable side rails defining a foldable putting training aid.

U.S. Pat. No. 4,718,674 discloses golf stance and swing training apparatus including frame members adjustable relative to each other for training a golfer for different types of swings and stances. The frame includes base members and a linear bar which extends upwardly and at an angle for providing a proper angle for swinging to a desired target and for other related purposes.

Several of the above described patents make mention of their ability to be folded or compacted to enable them to be carried by a user, as in a golf club bag. However, most of the apparatus discussed above are rather large and consequently cannot be conveniently carried by a user. Rather, they are located in a relatively permanent location or else are designed to be used in a home or office environment, but not on a golf course or on a driving range.

The apparatus of the present invention is able to be used and easily carried by a golfer and is relatively simple in both structure and use, and at the same time is versatile for training a golfer in at least three ways. The three ways include training for stance, for pitching, and for putting. Moreover, the apparatus may be used by both right-handed and left-handed golfers.

SUMMARY OF THE INVENTION

The invention described and claimed herein includes four separate elements, including a primary element having a plurality of index apertures along two edges, a pair of side elements having index pins for inserting into desired index apertures of the primary element, and a locator element having index pins for inserting into apertures of the primary element.

The two side elements also include appropriate attaching elements for securing them together longitudinally to provide a parallel element to the primary element for putting purposes. The side elements may be spaced apart the desired distance to correspond to the desired width of the users feet for proper spacing for any particular type of golf swing. The locator element may be placed in any desired location and at the proper orientation to align a user's foot with respect to the primary bar and to properly locate a ball.

Elements for securing the apparatus to the ground are included in appropriate grooves. All of the elements included may be secured together to comprise a compact package for conveniently carrying the apparatus in a golf club bag.

Among the objects of the present invention are the following:

- To provide new and useful golf training apparatus;
- To provide new and useful golf training apparatus for training stance, pitching, and putting;
- To provide new and useful training apparatus for golfers having adjustable elements securable together for transporting;
- To provide new and useful training apparatus for training golfers; and
- To provide new and useful golf training apparatus which is compact and easily transported.

BRIEF DESCRIPTION OF THE DRAWINGS

FIG. 1 is a perspective view of the apparatus of the present invention.

FIG. 2 is a top view of the apparatus of the present invention.

FIG. 3 is a view in partial section taken generally along line 3—3 of FIG. 1.

FIG. 4 is a view in partial section taken generally along line 4—4 of FIG. 1.

DESCRIPTION OF THE PREFERRED EMBODIMENT

Figures 5, 6, 7, 8, 9, 10, 11, 12, 13, 14, 15:
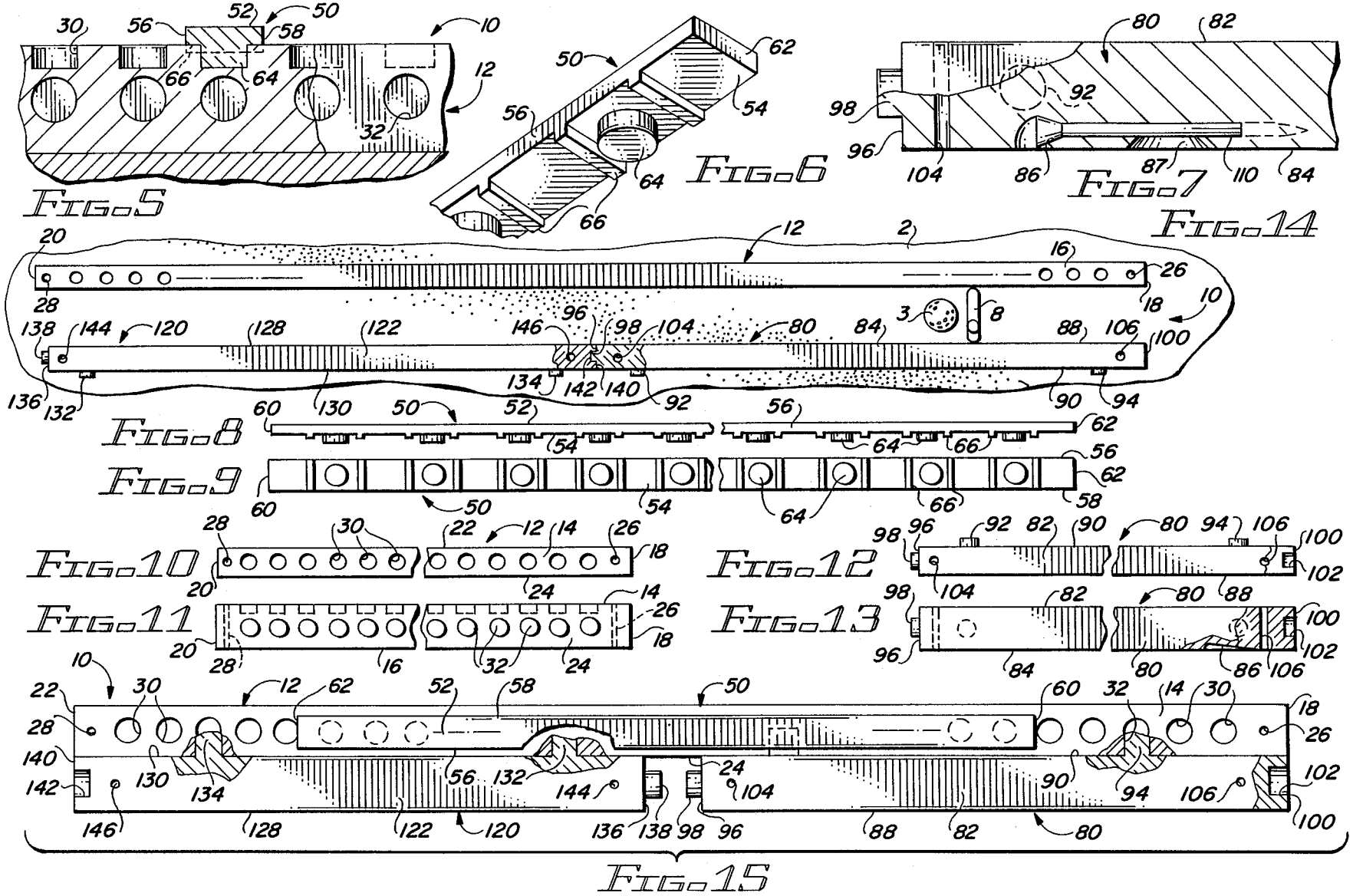
FIG. 5 is a view in partial section taken generally along line 5—5 of FIG. 1.
FIG. 6 is a bottom perspective view of a portion of the apparatus of the present invention.
FIG. 7 is a side view in partial section of a portion of the apparatus of the present invention.
FIG. 8 is a side view of a portion of the apparatus of the present invention.
FIG. 9 is a bottom view of the apparatus of FIG. 8.
FIG. 10 is a top view of a portion of the apparatus of the present invention.
FIG. 11 is a side view of the apparatus of FIG. 10.
FIG. 12 is a top view of another portion of the apparatus of the present invention.
FIG. 13 is a top view of the apparatus of the present invention in an alternate use embodiment.
FIG. 14 is a side view of the apparatus of FIG. 13.
FIG. 15 is a top view of the apparatus of the present invention, with portions broken away, showing the apparatus in its storage mode.

FIG. 1 is a perspective view of golf training apparatus 10 of the present invention shown in its use environment. The use environment includes the surface of ground 2. User's right and left footprints 4 and 6 are shown in dotted outline in FIG. 1. The apparatus 10 includes a front panel or base 12, a locator panel 50, and two side panels, including a side panel 80 and a side panel 120.

FIG. 2 is a top view of golf training apparatus 10 in its use environment, with the right and left footprints or foot outlines 4 and 6 shown disposed adjacent to the side panels 80 and 120, respectively, and with the toes or front portions of the foot outlines resting against the front panel or base 12. In both FIGS. 1 and 2, the locator panel 50 is shown adjacent to the inside of the user's left foot 6, and a golf ball 3 is shown in FIG. 1 disposed at the front of the locator bar 50.

FIG. 3 is a view in partial section through the base 12 and the locator panel 50, taken generally along line 3—3 of FIG. 1. FIG. 4 is a view in partial section through the base 12 and the end panel 120, taken generally along line 4—4 of FIG. 1. FIG. 5 is a view in partial section through the base 12 and the locator bar 50, taken generally along line 5—5 of FIG. 1.

FIG. 6 is a rear bottom perspective view of a portion of the locator bar 50. FIG. 7 is a view in partial section taken through a portion of the right panel 80.

FIGS. 8 and 9 are side and bottom views, respectively, of the locator panel 50.

FIGS. 10 and 11 are top and side views, respectively, of the base 12.

FIGS. 12 and 13 are a top view and a side view, respectively, of the side panel 80.

For the following discussion of the apparatus 10, and of the individual elements of the training apparatus 10, reference will be made generally to FIGS. 1, 2, 3, 4, and 5, with particular emphasis as to a particular element specifically referring to particular drawings, from time to time. For the front panel or base panel 12, reference will be made to FIGS. 10 and 11, in addition to FIGS. 1, 2, 3, 4, and 5. For the locator panel 50, reference will particularly be made to FIGS. 8 and 9, in addition to FIGS. 1, 2, 3, 5, and 6. For the side panels 80 and 120, reference will particularly be made to FIGS. 7, 12, and 13, in addition to FIGS. 1, 2, and 4.

The front panel or base element 12 is a generally rectangularly configured, and elongated element, which includes a top surface 14, a bottom surface 16, an end surface 18, an end surface 20, and a front surface 22 and a rear surface 24. It will be noted that the end surface 18 and 20 are disposed or squared quite far apart from each other. That is, the length of the base element 12 is somewhat longer than the widest stance that an individual golfer could reasonably be expected to take.

The respective top and bottom surfaces, end surfaces, and front and rear surfaces, are generally parallel to each other and are generally perpendicular to the adjacent surfaces.

Extending downwardly from the top surface 14 is a plurality of top holes or bores 30. The holes or bores 30 are illustrated as being round, but they may also be square or other, if desired. This particular feature will be discussed again in conjunction with the locator panel 50.

The top holes or bores extend downwardly from the top surface 14 for a predetermined distance or depth. The holes 30 are spaced apart from each other a regular or predetermined distance.

Extending between the front and rear surfaces 22 and 24, respectively, is a plurality of round, horizontal holes or bores 32. The holes or bores 32 preferably extend through the base 12. The holes 32 are shown aligned with the top holes 30. However, they need not be so aligned.

Adjacent to the end surface 18, extending between the top surface 14 and the bottom surface 16, is an anchor pin hole 26. Adjacent to the end 20, and extending also through the base 12 between the top surface 14 and the bottom surface 16 is a second anchor pin hole 28. In FIG. 1, a pair of anchor pins 110 is shown extending through the anchor pin holes. The anchor pins secure the base 12 in a desired location.

The locator panel 50 is a relatively long, also rectangularly configured, panel. It includes a top surface 52, which is generally smooth. The locator panel 50 also includes a bottom surface 54. The bottom surface 54 is generally parallel to the top surface 52.

The locator panel 50 also includes a pair of side surfaces, including a side surface 56 and a side surface 58. The locator panel 50 also includes a pair of end faces, including an end face 60 and an end face 62.

Extending downwardly from the bottom surface 54 of the locator panel 50 is a plurality of pins 64. Adjacent to each pin is a pair of ribs 66. The pins and ribs both extend downwardly from the bottom surface 54, with the pins 64 extending downwardly beyond the ribs 66. The ribs 66 extend between the side surfaces or sides 56 and 58, and are generally perpendicular to the side surfaces.

The diameter of the pins 64 are substantially the same as the diameter of the holes or bores 30 which extend downwardly from the top surface 14 of the base 12. The pins 64 are spaced apart from each other predetermined distances. The ribs 66 are spaced apart from each other predetermined distances which are equal to the width of the base 12, or the distance between the front and rear surfaces 22. As best shown in FIG. 3, when a pin 64 is inserted into a hole or bore 30, the ribs 66 are disposed on the sides 22 and 24 of the base 12 to securely hold the locator panel 50 in a predetermined orientation, namely perpendicular, to the longitudinal axis of the base 12.

With the plurality of pins 64 extending downwardly from the surface 54, the locator panel 50 may be disposed at any longitudinal location, with any amount of the locator panel extending in front of and behind the front panel or base 12. Moreover, the locator panel 50 may be located as desired along the length of the locator panel 12.

It will be noted, as referred to above, that the holes 30 and the pins 64 are round. As also noted, they may be configured differently, if desired, with round holes. The ribs 66 are required to maintain a perpendicular relationship between the base 12 and the locator bar 50. If a non-circular configuration of holes and pins were used, the ribs would not be required. Square, rectangular, triangular, star, or some other configuration may be used, if desired. For manufacturing purposes, such as plastic molding, round holes and pins and ribs are convenient.

In FIG. 1, a golf ball 3 is shown disposed adjacent to the front end 60 of the locator panel 50. The locator panel 50 is disposed to the inside of the left foot 6 of the user of the apparatus 10. The ball 3 is shown in FIG. 1 in the correct location for practicing with woods and/or long irons. For practicing with short irons, the locator bar 50 would be moved more to the center of the panel 12. The side panels 80 and 120 may also be moved or spaced apart or located appropriately in accordance with the type of club being used, and according to the physical size of the user.

The side panel elements 80 and 120 are substantially identical. Accordingly, only the side panel 80 will be discussed in detail.

The side panel 80 has a rectangular cross-sectional configuration. It includes a top surface 82, a bottom surface 84, with a plurality of pin depressions 86 extending into the bottom surface 84. The pin depressions 86 receive anchor pins, such as the anchor pin 110. The pin depressions 86 are best shown in FIG. 7. The pin depressions 86 comprise storage compartments for the anchor pins. The pin depressions 86 include finger and thumb depressions 87 to help remove the pins from the depressions 86.

The side panel 80 also includes a pair of side surfaces, including a side surface 88 and a side surface 90. The side surfaces 88 and 90 are generally parallel to each other, as are the top and bottom surfaces 82. A pair of pins 92 and 94 extend outwardly from the side surface 90. The configuration of the pins 92 and 94 match the size and configuration of the holes 32 of the base element 12.

The side panel 80 includes a front end surface 96 and a rear end surface 100. A pin 98 extends outwardly from the front surface 96, and a bore 102 extends inwardly from the rear end surface 100.

Adjacent to the front surface 96, and extending through the side panel 80 between the top surface 82 and the bottom surface 84 is an anchor pin hole 104. A second anchor pin hole 106 extends through the side panel 80 between the top surface 82 and the bottom surface 84 adjacent to the rear end surface 100. The anchor pin hole 106 is inwardly from the bore 102. This is best shown in FIGS. 12 and 13.

The side panel element 120 is substantially identical to the side panel 80, as indicated above. The side panel 120 includes a top surface 122, and a bottom surface, not specifically shown. The two surfaces are disposed substantially parallel to each other. The side panel 120 also includes a plurality of pin depressions extending upwardly from the bottom surface 124 for receiving anchor pins.

The side panel element 120 includes a pair of side surfaces 128 and 130, similarly disposed substantially parallel to each other. A pair of pins 132 and 134 extend outwardly from the side surface 130. The pins 132 and 134 are adjacent to a pair of end surfaces, with the pin 132 adjacent to a front end surface 136, and the pin 134 adjacent to a rear end surface 140. A pin 138 extends outwardly from the front end surface 136. A bore 142 extends inwardly from the rear end surface 140.

A pair of anchor pin holes, including an anchor pin hole 144 and an anchor pin hole 146, extend between the top surface 122 and the bottom surface of the side panel 120. The anchor pin hole 144 is adjacent to the front end 136, and the anchor pin hole 146 is adjacent to the rear surface 140.

In FIG. 2, six anchor pins 110 are shown extending through the front or base panel 12 and the side panels 80 and 120. Each of the three panels is shown utilizing two anchor pins. If desired, of course, four pins only may be required, perhaps eliminating the front anchor pins in the side panels 80 and 120. Thus, the apparatus 10 would be secured to the ground only with anchor pins extending through the apertures 26 and 28 of the base 12, and through the apertures 106 and 146 of the side panels 80 and 120, respectively.

Referring again to FIGS. 1, 2, 3, 5, and 6, the top holes or bores 30 in the front or base panel 12 may be square, or other, rather than round, if desired. In such case, the pins 64 of the locator panel 50 would also be of the same configuration, rather than round. This has been discussed briefly, above. If square holes and square pins were utilized in the apparatus 10, the ribs 66 would not be needed.

The utilization of non-circular holes and matching pins, whether they be square, rectangular, triangular, or round, etc. would of themselves result in the proper alignment of the locator panel 50 with respect to the base 12, and also with respect to the side panels 80 and 120. The utilization of non-circular hole and non-circular pins is thus a matter of choice. It is, of course, desired that the locator panels 50 be disposed substantially perpendicular, with respect to its longitudinal axis, to the base 12, or to the longitudinal axis of the base 12. The locator bar 50, or its longitudinal axis, is thus parallel to the longitudinal axes of the side panels 80 and 120.

FIG. 14 is a top view of the base panel 12 disposed on the ground, with the side panels 80 and 120 secured together to make a single, substantially continuous panel. The substantially continuous panel, comprised of the panels 80 and 120, is shown in FIG. 14 disposed generally parallel to, and spaced slightly apart from the base element 12. The golf ball 3 is shown between the aligned panels, and a golf putter 8 is also illustrated between the panels and adjacent to the ball 3. The panel 12 is spaced apart from the combined panels 80 and 120 a distance slightly greater than the overall length of the putter head 8.

Four anchor pins may be utilized to secure the base element 12 and the combined elements 80–120 as shown for putting practice. The anchor pins may extend through the anchor holes 26 and 28 in the base 12, and through the anchor hole 106 in the side panel 80 and the anchor hole 144 in the panel 120. Anchor pins will not be needed, generally, through the anchor holes 104 and 146, of the panels 80 and 120, respectively.

FIG. 14 illustrates how the pin 98, extending outwardly from the end 96 of the side panel 80, extends into the bore 142 in the rear end 140 of the side panel 120.

The bores and pins for the side panels 80 and 120 could also be non-circular, if desired, to facilitate the proper orientation of the side panels when used for putting practice, as illustrated in FIG. 14.

It will be noted that the side panels 80 and 120 may be connected at either end, as desired. However, if non-circular pins are utilized, extending outwardly from the front surface of the side panels 80 and 120, then the apertures 32, which extend through the base 12, would have to be of the same geometric configuration. As shown in FIGS. 1 and 2, the side panels 80 and 120 are secured to the base panel 12 with their front pins extending into the apertures or bores 32. It will be noted that with the plurality of apertures or bores 32, the side panels 80 and 120 may be secured to the base panel at any desired location, within the length of the base 12, to accommodate virtually any stance of a user. The overall length of the base panel 12 is such to accommodate various stances, from the widest to the narrowest, of golfers of various heights.

As best illustrated in FIGS. 1 and 2, the overall length of the side panels 80 and 120 need not be much longer than the anticipated length of a user's foot. For practical purposes, as illustrated in FIG. 14, when the side panels 80 and 120 are secured together to comprise a single panel, to be spaced apart from the base panel 12, the overall length of the combined side panels should be about the same as the length of the base panel 12 for putting practice purposes.

From what has been discussed above, it will be understood that the front pins 98 and 138 of the side panels 80 and 120, and the side pins 92 and 94 of the side panel 80 and the side pins 132 and 134 of the side panel 120, are substantially identical. They are all designed to fit into the apertures 32 of the base 12 for transporting and for storing. The elements or components of the apparatus 10 may be conveniently nested together generally parallel to each other as illustrated in FIG. 15. In FIG. 15, the side pins 92 and 94 of the side panel 80 extend into the appropriate holes or apertures 32 to secure the panel 80 to the base 12. Similarly, the side pins 132 and 134 of the side panel 120 extend into a pair of the holes 32 for storage purposes. Obviously, the distance between the pins 92 and 94 and the pins 132 and 134 is correlated to the spacing of the holes 32.

The locator panel 50 is secured to the top 14 of the base 12 for transport and storage purposes, as also shown in FIG. 15. Again, the spacing between the downwardly extending pins 64 of the locator panel 50 is correlated with the overall spacing of the bores 30 which extend downwardly from the top surface 14 of the base panel 12. The four elements of the apparatus 10 accordingly nest together for transport and storage purposes, as shown in FIG. 15.

Returning again to FIG. 7, an anchor pin 110 is shown disposed in the pin depression 86 for storage and transport purposes. For convenience, each of the panels 80 and 120 may include three depressions 86 to accommodate three anchor pins 110. If only four anchor pins are desired, then each of the panels 80 and 120 need only include two pin receiving depressions 86. However, for practical purposes, it may be convenient to utilize six anchor pins, as suggested in FIGS. 1 and 2. If desired, all of the anchor pin depressions may be in one of the side panels.

Referring again to the discussion of the locator bar or panel 50, and to FIGS. 1, 2, 3, 5, and 6, instead of using the ribs 66 or non-circular holes for the locator panel 50, smaller diameter pins could be utilized, along with smaller diameter holes or apertures adjacent to the top holes or bores 30. The combination of pins, large and small, could be used to secure the locator panel 50 in an appropriate, perpendicular relationship with respect to the base 12.

Also, if desired, the holes 32 on the side 24 of the base 12 may be appropriately color coded for convenience in placing the side panels 80 and 120 for a particular club. In the alternative to color coding, tags or markers of some kind could be utilized for quick reference and identification purposes.

Referring again to FIGS. 1 and 2, an alternative embodiment of a locator bar is illustrated. In FIGS. 1 and 2, adjacent to the outline of the right foot 4, there is shown an alternate embodiment locator panel 150. The locator panel 150 comprises a dowel of a predetermined length which extends into and through the round, horizontal holes or bores 32, in a desired location. The diameter of the locator element 150 is substantially the same as the diameter of the holes or bores 32. Accordingly, the locator element 150 may be easily inserted into and removed from any desired hole or bore 32.

Obviously, the utilization of a round dowel as a locator element 150 simplifies the manufacture of the apparatus over that of the locator panel 50. While the locator panel 50 includes its own storage elements as an integral part thereof, the use of the locator element or rod 150 requires the addition of fastening elements, or clips. A pair of such clips 156 is illustrated in FIG. 2.

The clips 156 are preferably simply generally "U" shaped plastic clips, well known in the art. The locator element 150 is simply pressed into the aligned pair of clips 156 to secure the element 150 to the base panel 12 for storage and transport purposes. The locator element or bar 150 may be placed in any relative location, and, with a generally uniform outer diameter, may extend on opposite sides of the panel 22 any appropriate or desired distance. Thus, in the use aspects of the locator element 150, it functions substantially the same as the locator bar or panel 50. The advantage of the locator bar 150 is that it is much simpler to make, and actually simpler to use since it conveniently extends through the holes or bores 32, and thus may be positioned at virtually any location and have any desired length extending outwardly from the base panel 12.

It will be understood that the drawings in the above discussion pertain primarily to right-handed golfers. However, it will also be obvious that the discussion would be applicable to left-handed golfers, with the apparatus reversed. Thus, instead of utilizing the locator panel 50 adjacent to the left foot 6, the locator panel 50 would be moved down to be disposed adjacent to the right foot 4. Accordingly, the practice apparatus 10 is applicable or usable for both right-handed and left-handed golfers.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Golf training apparatus, usable on the ground or inside, comprising, in combination:

base element means for providing a base against which a user stands;

first side panel means adjustably secured to the base element means for providing a first guide against which the user may place one foot to provide a proper stance;

second side panel means adjustably secured to the base element means for providing a second guide against which the user may place a second foot to provide the proper stance;

locator bar means adjustably secured to the base element means for locating a golf ball relative to the base element means and to the first and second side panel means and to the user for providing a proper ball location for practice swinging; and means for nesting the base element means, the first and second side panel means, and the locator bar means together for storage and transport purposes.

2. The apparatus of claim 1 in which the base element means includes first fastening means for securing the locator bar means to the base element means.

3. The apparatus of claim 2 in which the first fastening means comprises clip means for nesting the locator bar means to the base element means.

4. The apparatus of claim 2 in which the locator bar means includes second fastening means for cooperating with the first fastening means to secure the locator bar means to the base element means of a plurality of locations.

5. The apparatus of claim 4 in which the first fastening means comprises a first plurality of holes.

6. The apparatus of claim 5 in which the second fastening means comprises a first plurality of pins for extending into any of the holes.

7. The apparatus of claim 1 in which the base element means further includes third fastening means for securing the first and second side panel means to the base element means.

8. The apparatus of claim 7 in which the first and second side panel means include fourth and fifth fastening means, respectively, for cooperating with the third fastening means for securing the first and second side panel means to the base element means.

9. The apparatus of claim 8 in which the third fastening means comprises a second plurality of holes.

10. The apparatus of claim 9 in which the fourth and fifth fastening means each comprises a pin for extending into any of the second plurality of holes.

11. The apparatus of claim 1 in which the first side panel means includes a first end and a pin extending outwardly from the first end, and the second side panel means includes a second end and a bore extending into the second end of the second side panel means for receiving the pin extending outwardly from the first end of the first side panel means for securing together the first and second side panel means, and the secured together first and second side panel means may be disposed generally parallel to the base element means to provide a practice putting embodiment.

12. The apparatus of claim 1 in which the base element means further includes sixth fastening means for securing the apparatus to the ground during use.

13. The apparatus of claim 12 in which the first and second side panel means further include seventh and eighth fastening means for securing the apparatus to the ground during use.

14. The apparatus of claim 13 in which the sixth fastening means includes apertures extending through the base element means and anchor pins extending through the apertures.

15. The apparatus of claim 14 in which the seventh and eighth fastening means include apertures extending through the first and second side panel means, respectively, and anchor pins extending through the apertures.

16. The apparatus of claim 15 in which the first and second panel means further include storage means for storing the anchor pins of the sixth, seventh, and eighth fastening means.

17. The apparatus of claim 1 in which the means for securing the base element and the first and second side panel means together includes pins extending outwardly from the first end second side panel means, and the base element means includes aperture means for receiving the pins.

18. The apparatus of claim 1 in which the locator bar means comprises a rod extendable through a base element means.

19. The apparatus of claim 1 in which the base element means includes a base panel, a plurality of apertures extending through the base panel, and the locator bar means comprises a rod selectively and adjustably extending through a desired one of the apertures.

* * * * *